United States Patent [19]

Thoenig

[11] 4,422,775

[45] Dec. 27, 1983

[54] DEVICE FOR CONTROLLING THE FUNCTIONS OF A WATCH AND FOR DISPLAYING THE STATE OF AT LEAST ONE OF THE CONTROLLED FUNCTIONS

[75] Inventor: Marcel Thoenig, Granges, Switzerland

[73] Assignee: ETA SA, Fabriques d'Ebauches, Granges, Switzerland

[21] Appl. No.: 421,544

[22] Filed: Sep. 22, 1982

[30] Foreign Application Priority Data

Sep. 23, 1981 [CH] Switzerland ..... 6129/81

[51] Int. Cl.[3] ..... G04B 23/02; G04B 27/02

[52] U.S. Cl. ..... 368/74; 368/190

[58] Field of Search ..... 368/69–74, 368/76, 185, 190–195, 308, 319, 320

[56] References Cited

U.S. PATENT DOCUMENTS

| | | | |
|---|---|---|---|
| 3,079,749 | 3/1963 | Byser | 368/74 |
| 3,702,530 | 11/1972 | Besson et al. | 368/319 X |
| 3,783,599 | 1/1974 | Tanaka | 368/74 |

*Primary Examiner*—Vit W. Miska

*Attorney, Agent, or Firm*—Pollock, Vande Sande & Priddy

[57] ABSTRACT

Mechanism for controlling the function of an analogue watch permitting the display of the state of at least one of the functions.

It comprises a disc 16 for displaying the states; a lever 8 articulated to the pull-out piece 6 and on which a push button 18 acts; a pawl 10 articulated at the end of the lever 8; a wheel 12 meshing with the wheel 14 which bears the disc 16. For one position of the pull-out piece 6, the push button 18 moves the lever 8 in such manner that the pawl 10 causes the rotation of the wheel 12 and of the indicator 16. For the other positions, the push button 18 has no effect.

6 Claims, 7 Drawing Figures

| θ | a | c | DISPLAY |
|---|---|---|---|
| 0° | 0 | 1 | OFF |
| 60 | 1 | 0 | (ON) PM |
| 120 | 1 | 1 | (ON) AM |
| 180 | 0 | 1 | OFF |
| 240 | 1 | 0 | (ON) PM |
| 300 | 1 | 1 | (ON) AM |

DEVICE FOR CONTROLLING THE FUNCTIONS OF A WATCH AND FOR DISPLAYING THE STATE OF AT LEAST ONE OF THE CONTROLLED FUNCTIONS

BACKGROUND OF THE INVENTION

The present invention relates to a device for controlling the functions of an analogue watch permitting display of the state of at least one of the controlled functions.

More particularly the control device according to the invention is of the type comprising a stem able to take up a plurality of axial positions with respect to the frame of the watch for controlling a plurality of functions of the watch, and a member pivotally mounted with respect to the frame and driven by the stem. Such control devices are well known. Most frequently, they comprise a sliding pinion mounted on the stem and the positions of which are controlled by the cooperation of a first member generally called the pull-out piece and a second member generally called the return bar acting on the sliding pinion. According to its position, the sliding pinion, or castle wheel, acts on different elements which enable different functions of the watch to be controlled. Conventionally, in particular in the case of analogue watches comprising an electric motor, these functions are the setting of time and the changing of the time zone, and also the correction of the display of dates and days of the week.

When the watch comprises these functions only, the user can check that the function has been suitably controlled simply by looking at the dial of the watch. This is indicated to him by the position of the hands or by the position of the date disc or that for the days of the week. When the analogue watch comprises another function, such as an alarm function, for example, the watch does not inherently comprise elements enabling display of the state of this function. The use of this function necessitates the possibility of indicating whether the alarm function is on or off and, in the event of the alarm function being on, whether an alarm time between 0 and 12 hours has been selected or, on the other hand, an alarm time between 12 and 24 hours. In the case of watches with a digital display, this sending back of information does not rise any problem, since it is easy to provide on the display cell an element informing the user of the state of the selected function and in particular of the alarm function.

BRIEF SUMMARY OF THE INVENTION

In order to solve this problem in the case of watches with an analogue display, a first object of the invention is to provide a device for controlling the functions of a watch, and in particular the alarm function, which permits the display of the state of at least one of the controlled functions and in particular of the alarm function.

A second object of the invention is to provide such a device which is as simple and reliable as possible and which is compatible with a stem and sliding pinion control device of conventional type.

To achieve this aim, the control device according to the invention comprises:

transmission means, for example a wheel mounted rotatably on an arbor connected to the frame of the watch, for driving an indicator for the states of the controlled function;

a mechanism cooperating with the member mounted pivotally and driven by the stem, that is to say the pull-out piece, to be brought into different positions by the member and comprising an active end for cooperating with the wheel or more generally the transmission means; and a push botton having an inoperative position and an operative position.

In the operative position, the push bottom cooperates with the mechanism. By means of the mechanism, action on the push botton produces a rotation of the wheel through a given angle or more generally a movement of the transmission means when the stem is in a predetermined position, for example the alarm control position. When the stem is in another position, the active end of the mechanism does not produce any rotation of the wheel or movement of the transmission means.

Preferably, the transmission means also controls an assembly for controlling the state of the function controlled by the position of the stem.

BRIEF DESCRIPTION OF THE DRAWINGS

In any case, the invention will be better understood on reading the following description of an embodiment of the invention given by way of non-limitative example. The description refers to the accompanying drawings, in which.

DETAILED DESCRIPTION OF THE PREFERRED EMBODIMEMT

The following detailed description relates more particularly to the case of the analogue display watch controlled by a motor and comprising an alarm function which is described and claimed in the published European Patent Application No. 80.200.937.3 for "Electronic watch with stepping motor and alarm circuit" filed in the name of the Applicant. It is a matter of course, however, that the control device which is the subject of the invention would apply to the case of other watches and for displaying the state of a function other than the alarm function. It is likewise self-evident that the introduction of the alarm time could be done differently from the way in which this is provided in the European Patent Application.

Figure 1:
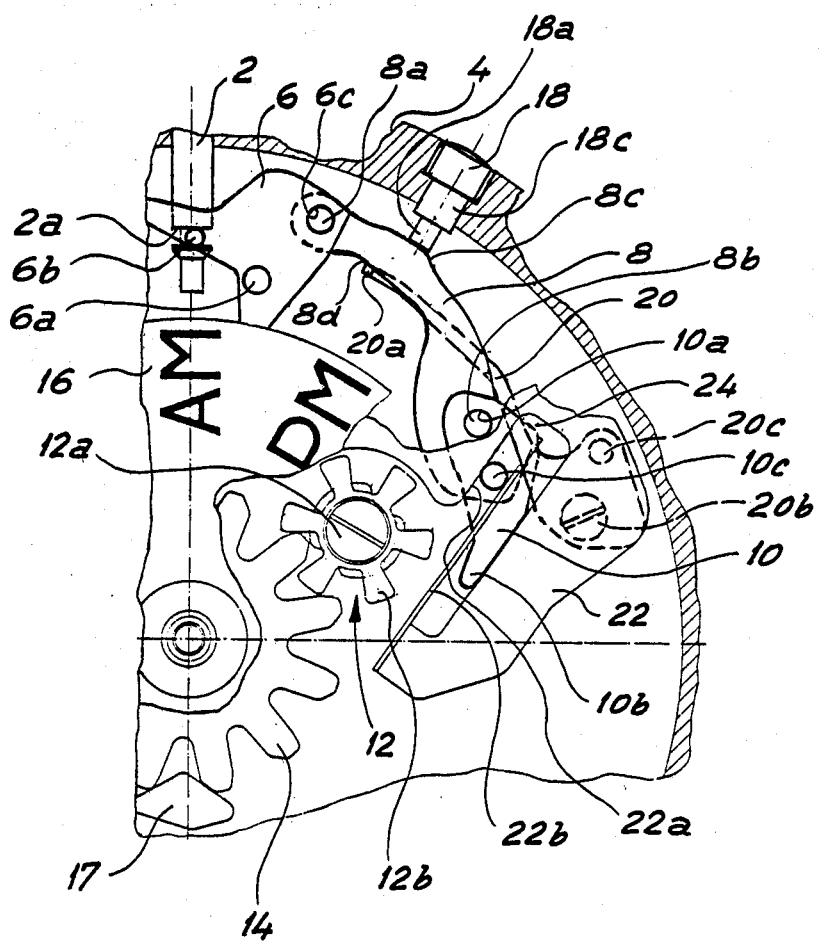
FIG. 1 is a simplified view of an embodiment of the control device which shows the various mechanical parts thereof.

FIG. 1 shows in a simplified form the control device according to a preferred embodiment. The control device comprises essentially a control stem 2 mounted slidably in the side wall 4 of the watch case, a pull-out piece 6 driven by the stem 2, a mechanism constituted essentially by a lever 8 at the end of which is mounted a pawl 10, and a toothed wheel 12 with which the pawl can cooperate. The wheel 12 meshes with a wheel 14 on which is mounted on indicator disc 16 for displaying the states of the alarm function. The wheels 12 and 14 form transmission means between the mechanism and the state indicator 16. Finally, a push botton 18 can act on the lever 8 to modify the position thereof and also that of the pawl 10 which is associated with it.

In more detail, as it is already well known, the pull-out piece 6 is pivotally mounted about a fixed arbor or spindle 6*a* and the stud 6*b* of the pull-out piece is engaged in a groove 2*a* of the control stem 2. Thus, the axial movements of the stem 2, which, for example, can take three different positions, are converted into pivotal movement of the pull-out piece 6 about its arbor 6*a*, whereas rotary movements of the stem 2 have no effect on the position of the pull-out piece 6.

A first end of the lever 8 carries a pin 8*a* engaged in a corresponding bore 6*c* of the pull-out piece. The second end of the lever 8 is provided with a second pin 8*b* engaged in a corresponding bore 10*a* of the pawl 10. The edge of the lever 8 comprises a first bearing surface 8*c* on which the end 18*a* of the push button can act and a second bearing surface 8*d* on which the end 20*a* of a return spring 20 acts. This return spring in the form of a blade or strip is fixed to the frame of the movement, for example by the screw 20*b* and the foot 20*c*. The end 20*a* of the return spring 20 is arranged in such manner that it acts substantially opposite the zone of action of th push button 18 on the lever 8.

At its end opposite that having the bore 10*a* the pawl 10 comprises an operative end 10*b* which can cooperate with teeth 12*b* of the wheel 12. A pin 10*c* is provided in the median region of the pawl 10. The pin 10*c* is guided in translation by a slide 24 defined by a support piece 22. The slide 24 is defined by an edge 22*a* of the support piece 22 and by a portion 22*b* of this support piece forming a flexible tongue. The pin 10*c* is therefore compelled to move in translation following the slide 24.

Figure 4:
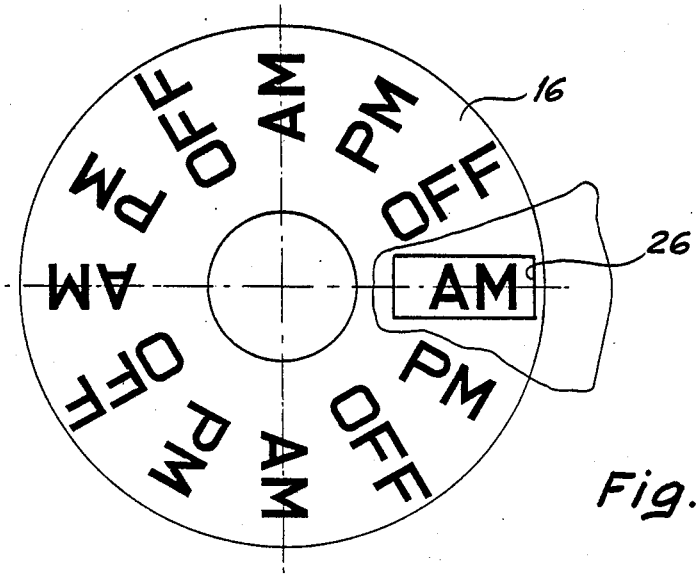
FIG. 4 is a partial view showing the indicator for the state of the alarm function.

FIG. 4 shows a possible embodiment of the disc 16 indicating the states of the alarm function. On this disc there are borne four identical groups of three indications, AM, PM and OFF, which respectively correspond to the indication that the alarm function is set or on for the time corresponding to the first part of the day displayed, that the alarm function is on for the time corresponding to the second part of the day displayed and, finally, that the alarm function is off. The various references borne on the disc 16 move along behind a window 26 formed in the dial of the watch.

Refering again to FIG. 1, it will be seen that the pawl 10 can engage with the wheel 12 which is pivotally mounted about the fixed arbor 12*a*. The wheel 12 has six teeth 12*b* and meshes with the wheel 14 which has twelve teeth, the wheel 14 being fixed for rotation with the disc 16. It will therefore be appreciated that each action of the pawl 10 on the wheel 12 produces an advance thereof by one sixth of a revolution. As a result the wheel 14 advances by one twelfth of a revolution and the indicator disc likewise advances by one twelfth of a revolution. Consequently, each action of the pawl produces an advance of the indicator disc by an angle corresponding to the sector associated with each word reference inscribed on the disc 16 and it is held there by the jumper 17.

Figure 2:
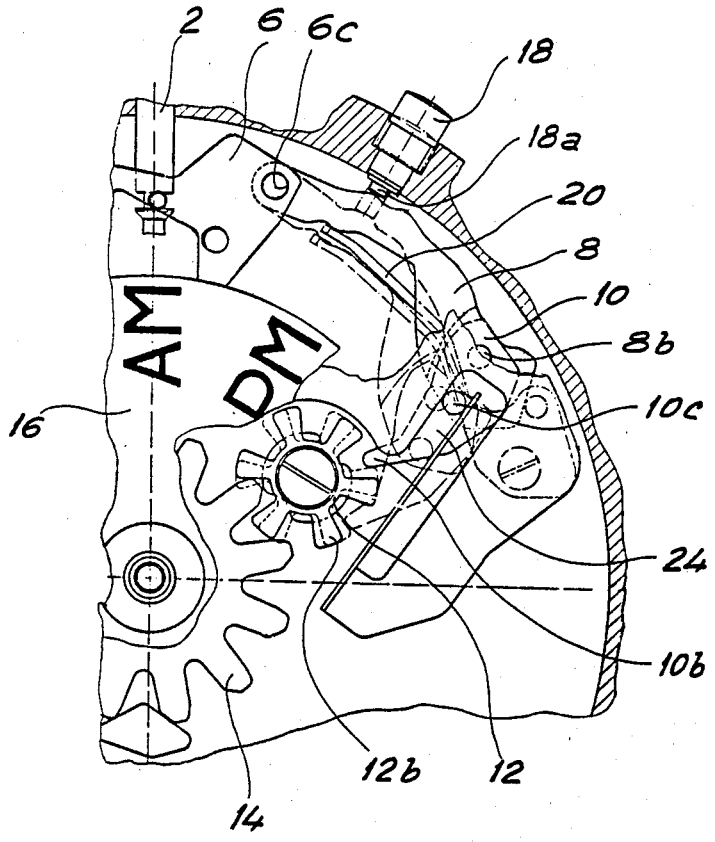
FIG. 2 is a top view of the mechanism when the stem is in the control position of the alarm function.

FIG. 2 illustrates the operation of the control device when the control stem 2 is in the position corresponding to the alarm function. The position of the stem fixes the position of the pull-out piece 6 and therefore of the pivot pin 8*a*. When the push button 18 is in the inoperative position, that is to say in the extended position, the position of the lever 8 is completely defined, on the one hand, by the position of the pivot pin 8*a* and, on the other hand, by the fact that the lever is urged against the operative end 18*a* of the push button 18 by the return spring 20. Consequently, the position of the pivot pin 8*b* is also completely defined. As a result the position of the pin 10*c* in the slide 24 is likewise perfectly defined. Consequently the over-all position of the pawl 10 and in particular of its operative end 10*b* is perfectly defined. As shown in FIG. 2, the end 10*b* is accommodated between two consecutive teeth 12*b* of the wheel 12, without, however, acting on the latter. These inoperative positions are shown in solid lines in FIG. 2.

When the user pushes the push button 18 in, the end 18*a* of the push button causes the lowering of the lever 8 owing to the deformation of the return spring 20. The pivot pin 8*b* therefore describes a circle about the pivot pin 8*a*. The pin 10*c* of the pawl 10 remains guided in the slide. The operative or active end 10*b* of the pawl shifts, producing the rotation of the wheel 12 by a sixth of a revolution. FIG. 2 shows the final position of the lever 8 and the pawl 10, which are represented in dash lines. When the user releases his action on the push button 18, the lever 8 and the pawl 10 resume their initial positions without acting on the wheel 12 due to the jumper 17.

Figure 3:
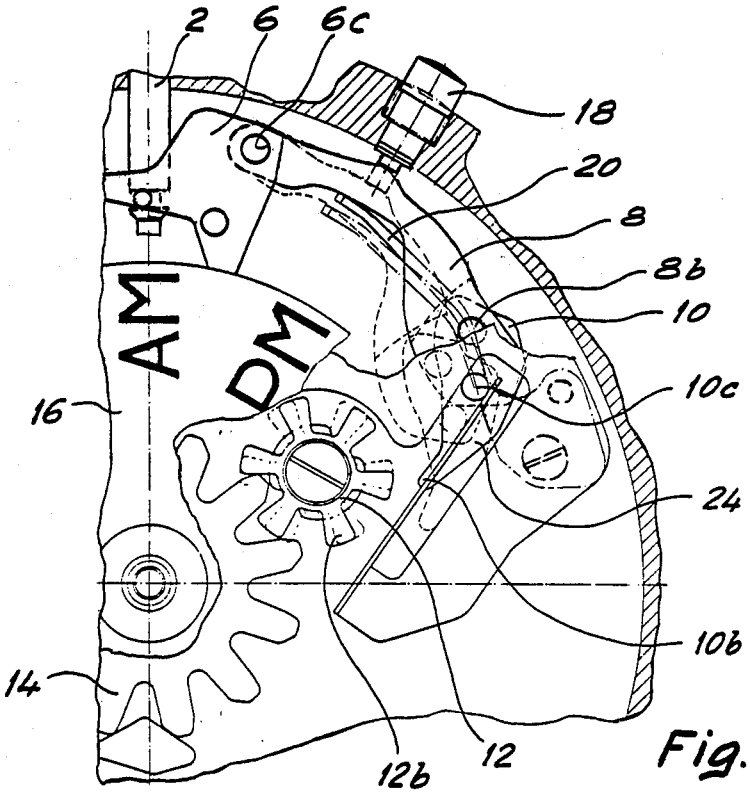
FIG. 3 shows the same mechanism when the stem is in another position.

FIG. 3 illustrates the operation of the control device in the case where the control stem thereof is not in the alarm position. The various parts of the mechanism are shown in solid lines in their initial position. In this initial position, the lever 8 is still urged against the end 18*a* of the push button 18 by the return spring 20. By reason of position of the stem 2, the position of the pivot pin 8*a* is altered. The same is therefore the case for the pivot pin 8*b* of the pawl 10. As the pin 10*c* is still imprisoned in the slide 24, the operative or active end 10*b* of the pawl 10 is not introduced between the teeth 12*b* of the wheel 12. When the user pushes the push button 18 in, the lever 8 pivots about the pin 8*a*. This tends to move the operative end 10*b* of the pawl 10 away still more with respect to the wheel 12. Throughout the displacement of the push button, the pawl therefore does not act on the wheel 12. Consequently, the position of the function state indicator is not altered. The same would be the case if the stem 2 were to be placed in a third position not corresponding to the alarm functon. What matters is that action on the push button 18 causes the pivoting of the function state indicator by one step solely for a single position of the stem. It could be envisaged that this position is not the alarm position, but a position corresponding to control of another function of the watch.

Up to now, only the mechanical operation of the control device has been described. This mechanical operation permits the display of the state of the function and in particular of the alarm function. It is obvious, however, that instructions corresponding to these states must be transmitted to the watch in order to control the performance of the alarm function. In order to describe this electrical part or control assembly for the state of the function, brief references to the watch described in the European Patent Application cited above are to be made.

In this watch, the alarm time is introduced through a wheel and pinion which are rotated by the rotation of the control stem 2 when this is in the alarm position. A detector system increments an auxiliary counter by a number of pulses which corresponds to the rotation of the hands to bring them to the alarm time. The contents of this counter can be loaded into an auxiliary memory. The contents of this auxiliary memory are compared with the contents of the time counter and when there is coincidence between the two contents the alarm is set off. It is necessary, however, to introduce information indicating whether the alarm is set or not and to introduce the information before 12 o'clock (AM) or after 12 o'clock (PM). Finally, it is necessary to be able to turn off the alarm.

Figure 5:
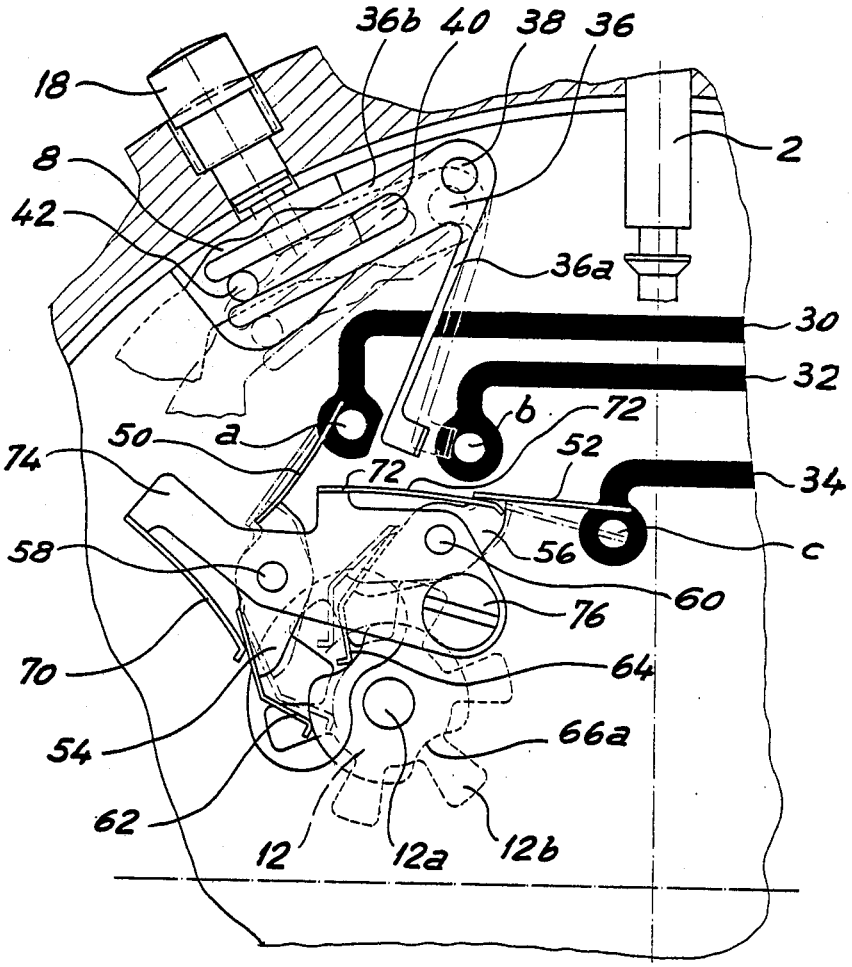
FIG. 5 is a partial bottom view showing the various electric contacts connected to the control device.

These various items of information are supplied to the control circuit of the watch in the form of pulses processed by the control device. FIG. 5 shows the control device from the back side of the movement and it permits better understanding of the manner in which the electric contacts are closed to process the electric pulses which have just been mentioned, that is to say the manner in which the state control assembly is constructed.

These signals are processed by the action of movable contacts on conducting studs a, b, c associated with the conducting tracks 30, 32 and 34, respectively, of the printed circuit of the watch. Contact with the stud b is directly controlled by the lever 8 under the action of the push button 18. This first contact is effected by a member 36 pivotally mounted about the pin 38 fast with the frame of the watch. The member 36 comprises, on the one hand, an arm 36*a* forming an electric contact and, on the other hand, an arm 36*b* defining a slide 40. A stud 42 fixed on the lever 8 is compelled to move in the slide 40. It will be understood that in this way, whatever the position of the stem, action on the push button 18 causes a pivoting of the lever 8 and a cooperation between the stud 42 and the slide 40 producing a pivoting of the member 36 about the pin 38. The movable contact 36*a* thus comes into contact with the stud b when the push button 18 is pushed in by the user.

Figures 5A, 5B:
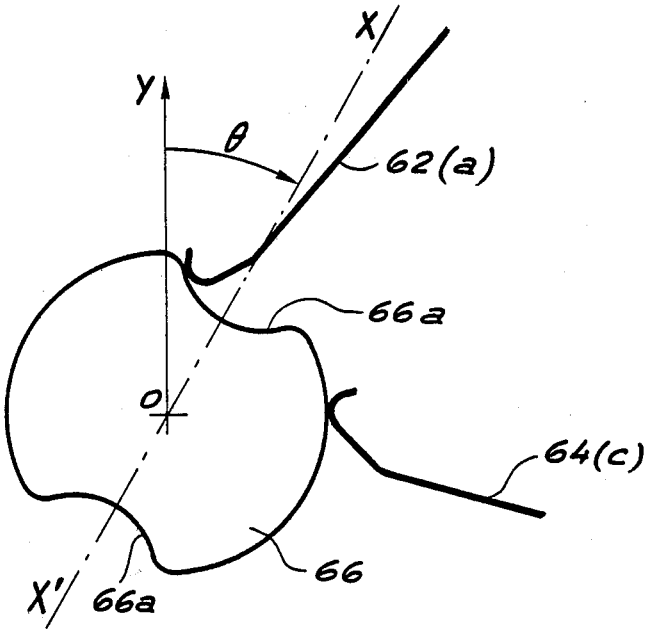
FIG. 5*a* shows a control cam for electric contacts which is associated with the state indicator.
FIG. 5*b* is a table giving the state of the contacts as a function of the position of the cam of FIG. 5*a*.

The studs a and c are associated with contact blades 50 and 52 mounted at the end of pivoting members 54 and 56. The members 54 and 56 are mounted to be able to pivot freely about fixed pins 58 and 60. At their second end, the members 54 and 56 are provided with feelers 62 and 64, respectively. Moreover, a cam 66 is fixed for rotation with the wheel 12. This cam is symmetrical with respect to a straight line intersecting the pivoting axis defined by the arbor 12*a*. It has two depressions 66*a*. Return springs 70 and 72 hold the members 54 and 56 in such manner that the feelers 62 and 64 remain in contact with the profile of the cam 66. These return springs 70 and 72 form integral parts of a support member 74. The support member 74 is fixed on the frame by means of the screw 76 and of the extensions fo the pivot pins 58 and 60 of the members 54 and 56. When the feeler 62 or 64 is in a depression 66*a* of the cam 66, the associated contact blade 50 or 52 is not in contact with the corresponding stud a or c. On the other hand, when these feelers are not in contact with the depressions, the corresponding contact blade comes into contact with the associated stud a and c. FIGS. 5*a* and 5*b* illustrate the state of the contacts a and c and the information displayed by the disc 16 as a function of the angular position of the cam 66. In these Figures $\theta$ is the angle between a fixed direction OY and the direction OX linked with the cam and passing through the depressions 66*a*. Moreover, in the Table of FIG. 5*b*, a contact has the value "0" when it is closed. The depressions 66*a* in the profile of the cam 66 correspond to an angle such that the Table of FIG. 5*b* is actually carried into effect.

It is apparent from the description that every time the user presses the push button 18 when the control stem is in the alarm position, the indicator 16 advances by one step and, simultaneously, a corresponding electric coding signal appears on the conducting tracks 30 and 34, thus controlling the electronic module of the watch. On the other hand, if the control stem is in another position, there is no action on the contacts a and c, but the contact b is closed with each pressure on the push button 18. The way in which the electric pulses are processed by the closing of the contacts a, b and c is described in the European Patent Application already mentioned, in which they have the same references. It is therefore not necessary to describe these circuits here. It will moreover be readily understood that the sequences of opening and closing of electric contacts described in connection with FIGS. 5*a* and 5*b* only constitute one example and many other sequences would be possible by modifying the cam, provided that the cam is synchronised with the disc displaying the state of the functions.

It will be appreciated by those skilled in the art, that in other types of watch, the cam could control mechanical members and not electric contacts.

Moreover, it is clear that the mechanism constituted, in the particular example described, by the lever 8 and the pawl 10 could be replaced by another mechanism fulfilling the same function. It is necessary that this mechanism has an operative or active part which is adopted to occupy at least two main positions when the push button is inoperative, namely a first position when the pull-out piece 6 is in the position in which the state of the function must be displayed and one or more second positions when the pull-out piece is in the other position or positions.

The first main position must be such that when the push button is actuated the mechanism modifies what is displayed. On the other hand, the second main position or positions must be such that when the push button is actuated the mechanism does not modify what is displayed. Although the embodiment described in detail corresponds to a simple, reliable and not very cumbersome solution, various other modifications of the present invention will be apparent to those skilled in the art, and it therefore is intended that the scope of the present invention be solely limited by the scope of the appended claims.

What is claimed is:

1. A device for controlling the functions of an analogue watch provided with a frame and performing a plurality of functions, at least one of which can adopt a plurality of states and for displaying the state of at least one of said controlled functions, comprising:

a stem able to take a plurality of axial positions with respect to said frame;

a member pivotally mounted on said frame and driven by said stem;

a movable indicator for displaying the states of the controlled function which is visible from out side the watch;

transmission means for driving said indicator;

a mechanism cooperating with said pivotally mounted member to be brought into different positions by said member and comprising an operative end for cooperating with said transmission means; and a push button having an inoperative position and an operative position, said push button in the operative position cooperating with said mechanism for said operative end to produce a movement of said transmission means when said stem is in a predetermined position, and for the said operative end to not act on said transmission means when said stem is in the other position or positions.

2. A device according to claim 1, further comprising a control assembly for the state of the controlled function comprising at least one electric contact, said control assembly being driven by said transmission means.

3. A device according to claim 2, wherein said mechanism comprises:

a first element forming a lever having a first and a second end, the first end thereof being articulated to said pivoting member;

a second element forming a pawl having a first and a second end, the first end thereof being articulated to said second end of said first element, said operative end of the mechanism consisting of said second end of said second element; and flexible means for applying a portion of said first element situated between first and second ends thereof against the inner end of said push button.

4. A device accoding to claim 3, wherein said transmission means comprises a first toothed wheel pivotally mounted on an arbor fixed on said frame and a second toothed wheel meshing with said first wheel and pivotally mounted on a second arbor fixed on said frame, and said state indicator comprises a disc in fast rotation with said second wheel.

5. A device according to claim 4, wherein said mechanism further comprises a pin member projecting from said second element between said first and second ends thereof and means forming a slide fixed on said frame of the watch for guiding said pin member in translation, said slide causing said second end of said second element to cooperate with said first wheel under the action of said push button when the first end of said first element occupies the position imposed by the position of the pivoting member when said stem is in said predetermined position, and said second end of the second element does not act on said first wheel for the other position or positions of said stem.

6. A device according to claim 4 or 5, wherein said assembly for controlling the state of the controlled function comprises a cam fixed for rotation with said first wheel and at least one electric contact, the position of which is controlled by said cam.

* * * * *